United States Patent [19]

Lamb

[11] Patent Number: 4,464,801

[45] Date of Patent: Aug. 14, 1984

[54] SWIMMING POOL COVER WITH ADJUSTABLE SIDE GORES

[76] Inventor: Joe H. Lamb, 117 W. Fireclay Ave., Murray, Utah 84107

[21] Appl. No.: 465,778

[22] Filed: Feb. 11, 1983

[51] Int. Cl.[3] ..... E04H 3/19

[52] U.S. Cl. ..... 4/502; 4/503

[58] Field of Search ..... 4/502, 498, 500, 503, 4/504

[56] References Cited

U.S. PATENT DOCUMENTS

| | | | |
|---|---|---|---|
| 3,050,743 | 8/1962 | Lamb | 4/502 |
| 3,273,171 | 9/1966 | Lamb | 4/502 |
| 3,277,498 | 10/1966 | Kleinbard et al. | 4/502 X |
| 3,747,132 | 7/1973 | Foster | 4/502 |
| 3,982,286 | 9/1976 | Foster | 4/502 |
| 4,001,900 | 1/1977 | Lamb | 4/498 |

*Primary Examiner*—Henry K. Artis

*Attorney, Agent, or Firm*—Workman, Nydegger & Jensen

[57] ABSTRACT

A novel swimming pool cover apparatus and method which utilizes adjustable side gores to eliminate undue tension in the swimming pool cover material. The apparatus includes a flexible, generally rectangular swimming pool cover sheet having beaded side edges and which is pre-cut with oversized side gores adjacent the leading edge thereof. The beaded side edges of the swimming pool cover sheet are slidably received into channels which are formed in parallel track members mounted on the pool deck adjacent to opposite sides of the swimming pool. The leading edge of the swimming pool cover is also provided with a beaded edge and is supported by a rigid carrier member having an open channel formed along the rearward side thereof. The bead of the leading edge of the cover sheet is slidably received into the channel formed in the rigid carrier member, and the carrier member is suspended at each end by respective wheel assemblies.

16 Claims, 5 Drawing Figures

SWIMMING POOL COVER WITH ADJUSTABLE SIDE GORES

BACKGROUND

1. Field of the Invention

This invention relates to swimming pool covers, and more particularly, to methods and apparatus for providing sufficient slack in the leading edge of swimming pool covers so that the cover material is not subjected to undue tension even when the leading edge is raised.

2. The Prior Art

For a number of reasons, it is advantageous and increasingly common to provide swimming pools with a swimming pool cover. For example, a cover substantially reduces pool maintenance time and costs by helping to keep dirt, leaves, and other debris from getting into the pool. A swimming pool cover also decreases the need for chemical treatment, and it can further help to minimize the energy which is required to heat the pool. Additionally, the use of a swimming pool cover when the pool is not in use greatly reduces the risk that an unattended child will accidentally enter the pool and be drowned.

Of course, one way to cover a swimming pool is to manually extend a large cover sheet across the pool and to thereafter secure the edges of the cover sheet to the pool deck. However, such a procedure is usually quite time consuming, and, additionally, more than one individual may be required in order to cover the pool properly. Therefore, in order to increase the convenience of using a pool cover, and in order to make the frequent use of a pool cover more practicable, many swimming pool owners make use of a pool cover which is mechanically extended and retracted across the swimming pool by an electric motor.

One type of pool cover which is well adapted to such mechanical extension and retraction comprises a large, rectangular cover sheet having thickened, or beaded, side edges. The beaded edges of the cover sheet are slidably received in open channels formed in respective, parallel tracks which are positioned adjacent to opposite sides of the swimming pool. Typically, there is sufficient slack in the cover sheet such that a portion of the cover sheet rests on the surface of the water after it is fully extended across the pool, with the beaded side edges being continuously maintained in and laterally secured by the respective channels.

When the swimming pool cover is not in use, the cover sheet is rolled upon an elongated cylindrical member which is located at one end of the pool. In order to cover the pool, the electric motor draws the edges of the cover sheet along the respective tracks so as to extend the cover sheet from one end of the swimming pool to the other. When the pool is to be uncovered, the motor rolls the cover sheet back onto the cylindrical member, and the cover sheet is thus retracted and stored for future use.

In order to minimize the likelihood that the leading edge of the pool cover will dip into the water during extension, thereby causing the water to flow onto the top of the cover sheet, mechanically extendible swimming pool covers are usually provided with a rigid leading edge. Optionally, the cover sheet may also have a central gore or a screen formed therein adjacent the leading edge of the pool cover, in order to allow for the drainage of any water which might collect on the cover sheet.

When a pool cover of the type described above is installed on a substantially rectangular swimming pool at the same time as such pool is being constructed, the side tracks are generally mounted inside the pool just below the pool deck. Thus, when the beaded edges of the cover sheet are properly positioned in their respective channels, the cover extends across the pool from one inside edge to the other. In such a configuration, the pool cover may be used without modification, and it can also be mechanically extended and retracted without difficulty.

The situation is quite different, however, when a mechanically extendible pool cover is installed on an existing rectangular swimming pool or on any pool which has a non-rectangular shape. In such cases, it is generally preferable to install a rectangular pool cover outside of the pool such that the parallel side tracks are secured to the top of the pool deck adjacent to the pool edges. This type of installation both eliminates the need to remove a portion of the pool deck and pool sides on existing pools and avoids the operational difficulties caused by attempting to mechanically extend and retract an odd-shaped swimming pool cover.

However, several difficulties arise when the pool cover is installed outside of the pool in this manner. First, it will be appreciated that a portion of the pool deck will necessarily underlie the pool cover after the cover is fully extended over the swimming pool, particularly in the case of odd-shaped pools. As a result, the pool cover will tend to drag across the pool deck's surface as it is extended and retracted, thereby making cover extension and retraction somewhat more difficult. Additionally, the pool cover's rigid leading edge may similarly drag across the surface of the deck, thereby causing undue wear both to the pool deck and to the rigid leading edge. Further, the rigid leading edge, which generally tends to sag slightly in the middle, may sometimes be unable to clear the odd-shaped or the endmost portions of the pool deck.

It has been found that the above difficulties may be overcome if the pool cover's leading edge is raised above the parallel side tracks. By so raising the leading edge, one can significantly reduce the frictional forces which resist pool cover extension and retraction. Further, raising the pool cover's leading edge eliminates the possibility that the leading edge will drag across the pool deck, and it thus insures that the leading edge will entirely clear all portions of the deck.

The exact height to which the leading edge must be raised is determined by the characteristics of the particular swimming pool. For example, when a swimming pool is substantially rectangular, the side tracks may be secured quite close to the pool edges, which are usually at about the same height. Therefore, when a pool cover is installed on an existing rectangular pool, it is typically necessary to raise the leading edge of the pool cover only slightly in order to achieve the desired benefits.

This is not the case, however, when such a cover is installed on an odd-shaped pool. Since the swimming pool cover sheet is rectangular, the side tracks must necessarily be laid down in substantially parallel, straight lines, regardless of the shape of the pool. Thus, when an odd-shaped pool is covered, some sections of the tracks may be positioned several feet away from the pool, while other track sections would be very close to the pool edge.

Since the pool deck typically slopes away from the pool in order to provide for proper drainage (this slope is generally about one inch for every four feet of lateral distance from the pool), the distant sections of the tracks may be several inches lower than the portions of the pool deck which are near the edges of the swimming pool. Consequently, in order to insure proper pool cover operation on odd-shaped pools, it is sometimes necessary to raise the pool cover's leading edge six or more inches above the two side tracks. Unfortunately, when attempting to appropriately raise a pool cover's leading edge so as to overcome the difficulties set forth above, several additional difficulties are encountered.

First, since the beaded side edges of the cover sheet are held captive in channels formed in the respective tracks, it may sometimes be impossible to raise the leading edge an amount sufficient to achieve the desired benefits. Additionally, any significant raising of the leading edge of the pool cover increases the tension in the cover sheet and, more particularly, in the beaded side edges of the cover sheet. This tension is often further increased after pool cover installation due to shrinking of the cover material.

Tension in the cover sheet may be detrimental to pool cover performance in a number of ways. For example, when placed under tension, the cover sheet may stretch or tear at a location adjacent the leading edge or the beaded side edges of the cover sheet may disengage from their respective channels. Further, excessive cover sheet tension may hinder the proper extension and retraction of the pool cover, or it may also cause the pool cover to be extended and retracted unevenly.

One solution to these additional problems was described in U.S. Pat. No. 4,001,900. Therein, it is suggested that triangular gores may be sewn onto each side of the cover sheet adjacent the leading edge so as to provide sufficient slack in the cover sheet to allow the leading edge to be raised to the proper height without creating undue tension. Although the addition of such side gores to the cover sheet has proven helpful, it has not proven to be completely satisfactory in several respects.

It will be appreciated that it is difficult to determine the exact height to which the pool cover's leading edge must be raised prior to the time that the pool cover is actually being installed. For this reason, it is also difficult to tell how large to make the side gores of the cover sheet prior to the time of pool cover installation. Since it is both time consuming and expensive to custom cut and fit the side gores at the installation site, it has become common for installers to prepare and have on hand several standard sizes of side gores. Thus, while the pool cover is being installed, two of the standard gores which are closest to the actual size needed are sewn onto the cover sheet by hand.

Since such gores are pre-cut to standard sizes, it is understandable that, in most cases, the side gores which are installed will be slightly larger than is actually necessary for the particular pool. If the side gores of the pool cover are too large, the gore material tends to bunch and to rub against the pool sides and deck when the pool cover is being extended and retracted. This rubbing significantly increases the noise during pool cover extension and retraction. Further, after a relatively short time, the gore material tends to wear so as to necessitate its replacement.

Of course, one potential way of eliminating the difficulties caused by oversized side gores is to raise the leading edge of the pool cover the additional amount which is needed in order to take up the excess slack in the gore material. However, when a pool cover's leading edge is raised more than the amount which is necessary to insure that the leading edge clears the pool deck, dirt tends to get into the pool under the leading edge, thereby nullifying some of the benefits of a swimming pool cover.

Additionally, if the leading edge is raised more than necessary, the appearance of the pool cover is generally less desirable, the pool cover is somewhat more of an obstruction, and a larger amount of gore material is exposed to the possibility of damage. Since these considerations are typically quite important to swimming pool owners, most owners prefer either to tolerate oversized side gores or to incur the additional expense of having their cover's side gores custom cut and fitted.

In addition, the prior art method of attaching side gores to a swimming pool cover has also been found to be somewhat undesirable. Since, as mentioned above, the exact gore size which is needed is unknown until pool cover installation begins, the necessary side gores are typically sewn onto the pool cover sheet by hand at the installation site. This sewing and fitting process can often be quite time consuming and tedious. Consequently, the sewing and fitting of side gores at the installation site may significantly increase the cost of producing and installing a swimming pool cover.

Accordingly, it would be an improvement in the art to provide a standard swimming pool cover with a raised leading edge, wherein the cover sheet is not subjected to undue tension, and which may be properly installed on various types of swimming pools without the need for custom cutting and fitting the appropriate size of side gores adjacent the leading edge of the pool cover. It would also be an improvement in the art to provide a mechanically extendible swimming pool cover which can be economically installed without using oversized side gores and without raising the leading edge of the pool cover more than the amount which is necessary to enable the cover's leading edge to clear the pool deck. Further, it would be an improvement in the art to provide a means whereby the requirement of sewing side gores onto the cover sheet at the installation site is avoided, even though the exact height to which the leading edge of the pool cover will need to be raised is unknown before installation begins. Still further, it would be an improvement in the art to provide a method for installing mechanically extendible swimming pool covers which eliminates the need for separately sewing on side gores but which also avoids any undue tension in the pool cover material caused by raising the leading edge of the pool cover. Such apparatus and methods are disclosed and claimed herein.

BRIEF SUMMARY AND OBJECTS OF THE INVENTION

The present invention is directed to a mechanically extendible swimming pool cover having a raised leading edge and adjustable side gores. Importantly, the adjustable side gores of the pool cover allow the installer to provide a proper amount of tension in the pool cover sheet, even though the same pool cover may be used on swimming pool of virtually any configuration.

The novel swimming pool cover of the present invention comprises a large, generally rectangular, flexible cover sheet which is pre-cut to include oversized side gores adjacent the leading edge thereof, the size of these gores being determined so as to permit the leading edge to be raised to the maximum height contemplated. The side edges of the cover sheet are thickened or beaded, and they are slidably received into open channels which are formed in parallel track members secured to the pool deck adjacent to opposite lateral edges of the swimming pool. The forward or leading edge of the cover sheet is also beaded and is similarly received into an open channel formed along the rearward side of a rigid, horizontal carrier member. This carrier member is suspended above the pool deck by wheel assemblies which are attached to the ends of the carrier member.

When installing the novel swimming pool cover of the present invention, the beaded edges of the cover sheet are inserted into the channels of the tracks and of the carrier member. The wheel assemblies are then attached to the carrier member so as to suspend both the carrier member and the pool cover's leading edge at the proper height. After the leading edge is thus suspended, the cover sheet's side gores are held in a substantially vertical position; however, when the leading edge is raised to less than its highest position, the side gores initially have substantial slack. The excess slack is then removed from the side gores by sliding the leading edge of the cover sheet inwardly along the channel in the carrier member so as to form or enlarge a center gore in the cover sheet adjacent the leading edge of the pool cover. Once the excess slack is removed and the desired cover sheet tension is achieved, the leading edge is secured against lateral movement within the carrier member channel by means of screws.

It is, therefore, a primary object of the present invention to provide a means for supplying the appropriate amount of slack in the cover sheet of a swimming pool cover, even though the leading edge of the pool cover may be suspended over a range of heights.

It is another object of the present invention to provide a standardized swimming pool cover having a raised leading edge and which may be properly installed on virtually any swimming pool without the need to custom cut and fit the appropriate size of side gores.

It is a further object of the present invention to provide a swimming pool cover having side gores which are adjustable for various different heights to which the leading edge of the pool cover may be raised.

It is yet another object of the present invention to provide a swimming pool cover which has side gores formed as an integral part of the swimming pool cover sheet, thereby eliminating the need to separately cut and attach the side gores.

It is a still further object of the present invention to provide a method for installing a mechanically extendible swimming pool cover so as to supply the appropriate amount of slack in the swimming pool cover material adjacent the leading edge thereof while also eliminating the need to separately sew on side gores.

These and other objects and features of the present invention will become more fully apparent from the following description and appended claims taken in conjunction with the accompanying drawings.

DETAILED DESCRIPTION OF THE PREFERRED EMBODIMENTS

The presently preferred embodiments of the invention will be best understood by reference to the drawings wherein like parts are designated with like numerals throughout.

Figure 1:
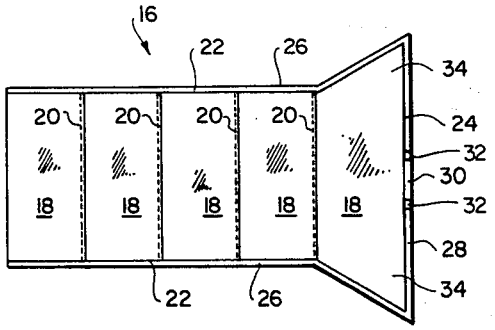
FIG. 1 is a top plan view of one presently preferred embodiment of the cover sheet of the swimming pool cover of the present invention, the lateral dimensions thereof being exaggerated so as to more clearly illustrate the position and form the the pre-cut side gores.

With reference to the drawings, the swimming pool cover of the present invention, generally designated 14, is secured over a swimming pool 10 and comprises a flexible cover sheet 16. As best shown in FIG. 1, cover sheet 16 is substantially rectangular in shape, having long lateral edges 22. As illustrated, however, cover sheet 16 is not exactly rectangular, in that its lateral edges 22 tend obliquely outward near the forward or leading edge 24 of cover sheet 16 such that cover sheet 16 is transversely enlarged adjacent its leading edge 24.

Cover sheet 16 may be suitably formed in a number of ways. For example, cover sheet 16 could be cut from a single, large sheet of cover material so as to be properly transversely enlarged adjacent its leading edge. Alternatively, cover sheet 16 may be formed from several cover sheet sections 18 which are joined together at seams 20, as illustrated in FIG. 1. When cover sheet 16 is formed in this latter manner, the section 18 which will form leading edge 24 of cover sheet 16 may be cut with appropriately oblique side edges, as shown in FIG. 1, while the other cover sheet sections 18 are all advantageously cut in a uniform, rectangular shape.

The lateral edges 22 of cover sheet 16 are provided with a thickened portion or bead 26 which extends along the entire length of cover sheet 16. This lateral bead 26 may be formed, for example, by folding lateral edges 22 of cover sheet 16 over a rope or cord and thereafter sewing the fold closed so as to secure the rope or cord therein. Alternatively, a separate, narrow strip of material having a pre-formed, lateral bead therein may be attached to the lateral edges 22 of cover sheet 16 so as to form lateral beads 26.

Leading edge 24 of cover sheet 16 is provided with a similar thickened portion or bead 28. Like lateral beads 26, forward bead 28 could be continuous along the entire length of leading edge 24. However, for reasons that will become apparent from the discussion which follows, it is presently preferred that forward bead 28 be discontinuous adjacent a central portion of leading edge 24. For example, in the preferred embodiment of cover sheet 16 which is illustrated in FIG. 1, forward bead 28 has two, central discontinuities or gaps 32 which define a central bead segment 30. Alternatively, forward bead 28 could have a single, relatively wide, central discontinuity or gap. Importantly, the length of central bead segment 30 (or, alternatively, of said single, central gap), is approximately the same as the amount by which cover sheet 16 is transversely enlarged adjacent its leading edge 24. In one preferred embodiment, for example, central bead segment 30 is approximately twelve inches long, with gaps 32 each being about one inch wide.

Figure 3:
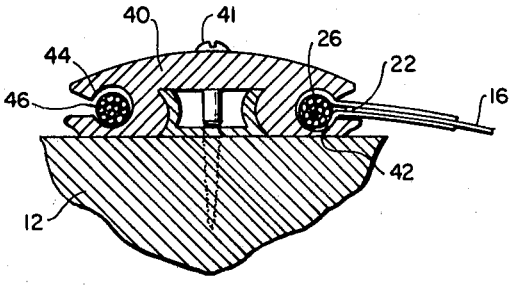
FIG. 3 is an end cross-section view of the pool cover track which is used in extending and retracting the swimming pool cover of the present invention taken along line 3—3 of FIG. 2.
Figure 2:
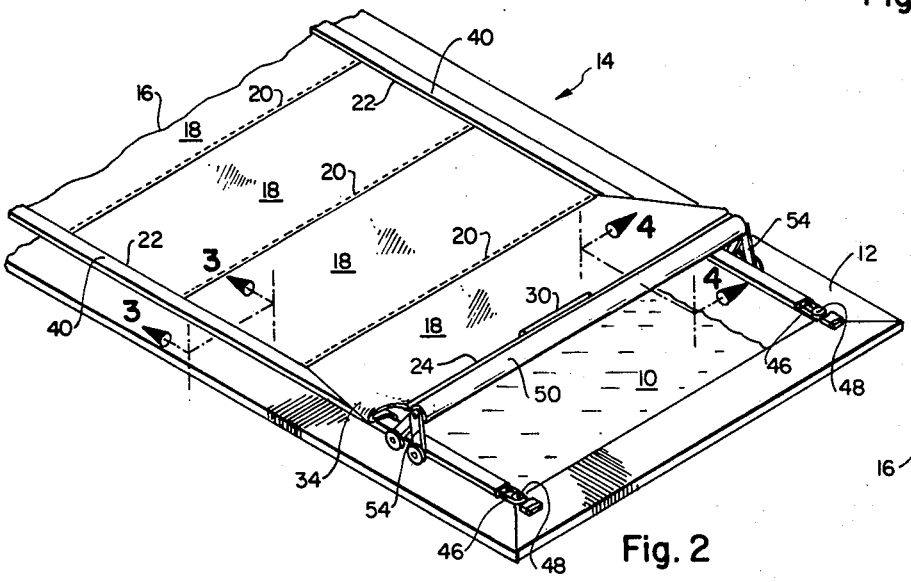
FIG. 2 is a perspective view of one preferred embodiment of the swimming pool cover of the present invention which has been installed on a substantially rectangular swimming pool without removing the excess slack in the side gores, the end portions of the tracks being cut away to reveal their interior construction.

With particular reference now to FIG. 2, swimming pool cover 14 further comprises two tracks 40 and a horizontal carrier member 50, which help secure the installed cover sheet 16 over swimming pool 10. As illustrated, tracks 40 are secured in a suitable manner to the pool deck 12 adjacent swimming pool 10 so as to be substantially parallel to one another. Tracks 40 may, for example, be secured to pool deck 12 by means of screws 41, as depicted in FIG. 3. As further illustrated in FIG. 2, horizontal carrier member 50 extends across swimming pool 10 so as to be substantially perpendicular to tracks 40. A wheel assembly 54 is connected to each end of carrier member 50 so as to suspend carrier member 50 several inches above pool deck 12, as shown.

Horizontal carrier member 50 and tracks 40 are preferably rigid members, and they may be constructed of a number of suitable materials. In one preferred embodiment, for example, both the horizontal carrier member 50 and the tracks 40 are formed of extruded aluminum.

As shown best in FIG. 3, tracks 40 each have two open channels 42 and 44 formed therein. Each open channel 42 is positioned toward swimming pool 10, and it slidably receives a lateral bead 26 of cover sheet 16. Open channels 42 thus secure the lateral edges 22 of a properly installed cover sheet 16 against lateral movement.

Figure 4:
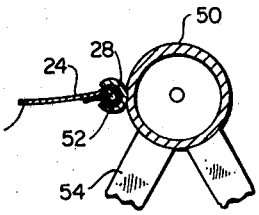
FIG. 4 is an end cross-section view of the horizontal carrier member to which the leading edge of the swimming pool cover sheet of the present invention is attached taken along line 4—4 of FIG. 2.

As shown best in FIG. 4, carrier member 50 has an open channel 52 formed along the rearward side thereof. This open channel 52 slidably receives forward bead 28 of cover sheet 16, thereby both supporting the leading edge 24 of cover sheet 16 and maintaining the leading edge 24 in a raised position.

Importantly, forward bead 28 is inserted into open channel 52 of carrier member 50 such that a central portion of leading edge 24 lies outside of open channel 52. When leading edge 24 is formed as depicted in FIG. 1, such insertion may be easily accomplished. In such case, one merely inserts forward bead 28 into open channel 52 while maintaining central bead segment 30 outside of open channel 52. Gaps 32 in forward bead 28 thus permit forward bead 28 to slide freely along open channel 52, even though a central portion of leading edge 24 remains outside of open channel 52. It will be appreciated that, when such insertion is complete, central bead segment 30 will lie outside of open channel 52, as illustrated in FIG. 2, while the remainder of forward bead 28 will be slidably maintained within open channel 52.

While the foregoing description relates specifically to one presently preferred configuration of forward bead 28, it will be appreciated that other configurations of forward bead 28 could be similarly inserted into open channel 52. For example, if forward bead 28 were continuous along the entire length of leading edge 24, a central portion of forward bead 28 could still be maintained outside of open channel 52, although forward bead 28 would thereby be subjected to a certain amount of stress at the points where it passed outside of open channel 52. Similar results could also be achieved if forward bead 28 had a single, relatively wide gap adjacent a central portion of leading edge 24.

In installing the pool cover 14 of the present invention, cover sheet 16 is typically rolled upon a cylindrical shaft (not shown) which is located adjacent one end of swimming pool 10. As illustrated in FIGS. 2 and 3, a rope 46 is attached to each of the forward ends of lateral beads 26 so as to extend in front of cover sheet 16, around pulleys 48 at the opposite ends of tracks 40, and through open channels 44 back to the other end of swimming pool 10. Ropes 46 are there attached to spool members (not shown) such that when ropes 46 are wound upon the spools, cover sheet 16 is drawn along tracks 40 and extended over swimming pool 10. When it is subsequently desired to uncover swimming pool 10, the swimming pool cover is again rolled upon the cylindrical shaft, where it may be compactly stored for future use. Advantageously, both the spool members and the cylindrical shaft may be driven by a motor according to means known in the art.

When swimming pool cover 14 is constructed and installed as described above, side gores 34 are formed adjacent the leading edge 24 of cover sheet 16, as shown in FIG. 2. Wheel assemblies 54 are then chosen or adjusted so as to maintain both the leading edge 24 and the carrier member 50 at a height which will allow them to clear all portions of the swimming pool deck 12. Since a central portion of leading edge 24 is not maintained within open channel 52 of carrier member 50, the excess slack in side gores 34 may then be removed by sliding the leading edge 24 of cover sheet 16 inwardly along open channel 52. By so doing, the desired amount of tension may be attained in side gores 34. At the same time, a center gore 36 is formed adjacent the center of leading edge 24, as illustrated in FIG. 5, with central bead segment 30 providing a degree of stability to center gore 36.

Figure 5:
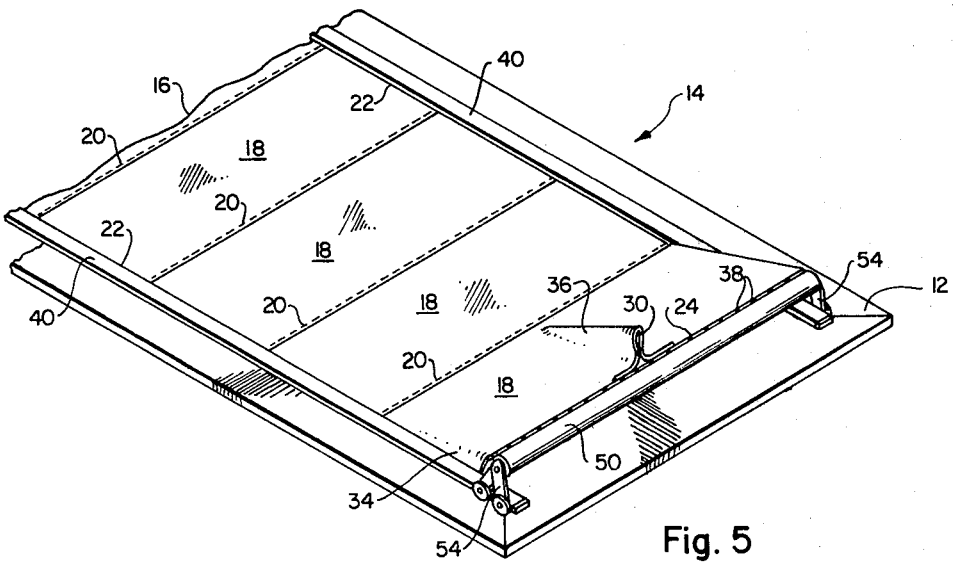
FIG. 5 is a perspective view of one preferred embodiment of the swimming pool cover of the present invention after it has been fully installed on a substantially rectangular swimming pool, with the slack in the side gores having been removed so as to form a center gore.

As further illustrated in FIG. 5, the leading edge 24 of the fully installed cover sheet 16 may be secured against further lateral movement in channel 52 by inserting screws 38 through the top of open channel 52 in carrier member 50. Center gore 36 may also be secured by clips or any other suitable means (such as, for example, velcro), or center gore 36 may be positioned downwardly and used as a drain for cover sheet 16 in the event that water accumulates on cover sheet 16 while pool cover 14 is extended over swimming pool 10.

In addition to the above, several optional features may also be included in the swimming pool cover of the present invention. For example, a screen can be placed in the pool cover near its leading edge so as to allow rain water to drain into the pool while filtering out large debris. Additionally, a center gore could be sewn into the leading edge, although this procedure is somewhat tedious, so that any additional, needed slack may be provided by pulling the leading edge of the pool cover toward the sides. Further, wheel assemblies 54 could be constructed so as to permit horizontal carrier member 50 to be brought flush with pool deck 12 after pool cover 14 is fully extended over swimming pool 10, thereby providing a tighter seal around swimming pool 10.

For purposes of illustration, the lateral dimensions of cover sheet 16 are greatly exaggerated in FIGS. 1, 3, and 5. In actuality, cover sheet 16 would typically be transversely enlarged by only a few inches adjacent its leading edge 24.

For example, in order to cover a 20 foot by 40 foot rectangular swimming pool, cover sheet 16 might be about 45 feet long and about 25 feet wide. Then, beginning about five feet away from leading edge 24, the two lateral edges 22 of cover sheet 16 might tend outwardly at an angle of about two degrees, such that cover sheet 16 is transversely enlarged adjacent its leading edge 24 by only about four or five inches.

Although such a cover sheet would be acceptable for most rectangular swimming pools, it would not allow leading edge 24 to be raised sufficiently to properly cover most odd-shaped pools. To meet the desired objectives when covering odd-shaped pools, cover sheet 16 may need to be transversely enlarged adjacent its leading edge 24 by as much as 12 to 16 inches. Thus, beginning about five feet away from leading edge 24, lateral edges 22 of cover sheet 16 would need to tend outwardly at an angle of about six or seven degrees.

Of course, it will be appreciated that the transverse enlargement of cover sheet 16 need not begin exactly five feet away from leading edge 24. Such enlargement could begin at a greater or lesser distance with equally acceptable results. The distance of five feet has been used above by way of example only.

From the above discussion, it will be appreciated that the present invention provides a means for supply the appropriate amount of slack in the cover sheet of a swimming pool cover, even though the cover's leading edge may be suspended over a range of heights. Since the leading portion of the swimming pool cover sheet is transversely enlarged, oversized side gores are provided which may be used with virtually any size pool without the need to custom cut and fit the appropriate size of side gores. Further, since the leading edge of the cover sheet is slidably received in a channel formed along the rearward side of the horizontal carrier member, the side gores may be adjusted to the exact size which is necessary for the particular application. Additionally, the present invention has provided a swimming pool cover having side gores wherein there is no need for the time consuming chore of separately sewing on side gores. Thus, it will be appreciated that the present invention has provided a method for installing a mechanically extendible swimming pool cover which has great versatility in its application to various sizes and shapes of swimming pools.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. An adjustable cover apparatus comprising:

a flexible sheet of material having a peripheral edge and a forward edge, a portion of said flexible sheet being transversely enlarged towards said forward edge;

means for securing the peripheral edge of the flexible sheet around an object to be covered; and means for supporting the forward edge of the flexible sheet above an adjacent portion of the flexible sheet, said supporting means being slidably connected to the forward edge such that excess slack in the transversely enlarged portion of the flexible sheet may be removed by sliding the forward edge along the supporting means towards a central portion of said support means.

2. An adjustable cover apparatus as defined in claim 1 wherein said flexible sheet is substantially rectangular in shape.

3. An adjustable cover apparatus as defined in claim 1 wherein said flexible sheet has at least one gore adjacent the forward edge, said gore providing said transverse enlargement.

4. An adjustable cover apparatus as defined in claim 1 wherein the forward edge of the flexible sheet is beaded and wherein said supporting means includes an open channel which slidably receives said beaded forward edge.

5. An adjustable cover apparatus as defined in claim 4 wherein the bead of the forward edge is discontinuous adjacent a central portion of said forward edge.

6. An adjustable cover for a swimming pool comprising:

a substantially rectangular, flexible sheet of material having a rearward edge, two lateral edges, and a forward edge, said flexible sheet being transversely enlarged adjacent said forward edge;

means for securing the rearward edge and the lateral edges of the flexible sheet around the swimming pool;

means for supporting the forward edge of the flexible sheet above an adjacent portion of the flexible sheet, said supporting means being slidably connected to the forward edge such that excess slack in the forward edge may be removed by sliding the forward edge along the supporting means towards a central portion of said supporting means; and means for extending and retracting the flexible sheet over the swimming pool.

7. An adjustable cover for a swimming pool as defined in claim 6 wherein said flexible sheet is formed of a plurality of sections of flexible material which are connected.

8. An adjustable cover for a swimming pool as defined in claim 6 wherein said flexible sheet has at least one gore adjacent the forward edge, said gore providing said transverse enlargement.

9. An adjustable cover for a swimming pool as defined in claim 6 wherein a forward portion of each lateral edge tends obliquely outward, thereby providing said transverse enlargement.

10. An adjustable cover for a swimming pool as defined in claim 6 wherein the forward edge of the flexible sheet is beaded and wherein said supporting means includes an open channel which slidably receives said beaded forward edge.

11. An adjustable cover for a swimming pool as defined in claim 10 wherein a central portion of said forward edge lies outside of the open channel of the supporting means.

12. An adjustable cover for a swimming pool as defined in claim 11 wherein the bead of the forward edge is discontinuous adjacent said central portion of the forward edge.

13. An adjustable cover for a swimming pool as defined in claim 10 wherein said supporting means comprises a substantially rigid, horizontal member having a wheel assembly connected to each end thereof.

14. An adjustable cover for a swimming pool as defined in claim 6 wherein said lateral edges are beaded and wherein said securing means comprises two parallel track members secured on opposite sides of the swimming pool, each track member having an open channel which slidably receives one beaded lateral edge.

15. A mechanically extendible swimming pool cover having a raised leading edge and adjustable side gores, comprising:

a substantially rectangular, flexible sheet of material having a forward edge, two lateral edges, and a rearward edge, the flexible sheet being transversely enlarged adjacent the forward edge so as to form two said gores adjacent said forward edge, the forward edge and the lateral edges of the flexible sheet also being beaded;

two substantially parallel track members secured on opposite sides of the swimming pool, each track member having a first open channel formed therein which slidably receives the beaded lateral edges of the flexible sheet;

a rigid, horizontal carrier member extending between said track members so as to be substantially perpendicular thereto, said carrier member including an open channel which slidably receives the beaded forward edge of the flexible sheet such that excess slack in the side gores may be removed by sliding the forward edge along the carrier member toward a central portion of the carrier member, thereby forming a center gore in the flexible sheet;

wheel assemblies connected to each end of the horizontal carrier member so as to suspend the carrier member above the track members; and means for extending and retracting the flexible sheet over the swimming pool.

16. A mechanically extendible swimming pool cover having a raised leading edge and adjustable side gores as defined in claim 14 wherein said track members each have a second open channel formed therein, and further comprising:

draw cords attached to the lateral edges of the flexible sheet for use in extending the pool cover across the swimming pool, said draw cords being adapted to travel within said first and second open channels of the track members; and a pulley assembly secured at an end of each track member, said pulley assembly including a pulley around which the draw cord travels upon exiting the first channel of the track member and before entering the second channel of the track member.

* * * * *